US008506061B2

(12) United States Patent
Park

(10) Patent No.: US 8,506,061 B2
(45) Date of Patent: Aug. 13, 2013

(54) METHOD AND APPARATUS FOR PURGING AND SUPPLYING INK TO AN INKJET PRINTING APPARATUS

(75) Inventor: Daniel Clark Park, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 358 days.

(21) Appl. No.: 12/861,177

(22) Filed: Aug. 23, 2010

(65) Prior Publication Data

US 2012/0044303 A1 Feb. 23, 2012

(51) Int. Cl.
*B41J 2/175* (2006.01)
*B41J 2/195* (2006.01)

(52) U.S. Cl.
USPC ..... 347/85; 347/7; 347/86; 347/93

(58) Field of Classification Search
USPC ..... 347/86
See application file for complete search history.

(56) References Cited

U.S. PATENT DOCUMENTS 4,256,470 A 3/1981 Zajicek et al.
4,314,264 A 2/1982 Bok et al.
4,320,407 A 3/1982 Goldis et al.
4,336,037 A 6/1982 Goldis et al.
4,460,903 A 7/1984 Guenther et al.
4,460,904 A 7/1984 Oszczakiewicz et al.
4,658,268 A 4/1987 Needham
4,792,292 A 12/1988 Gaenzle
5,126,752 A 6/1992 Weinberg
5,296,875 A 3/1994 Suda
5,691,753 A 11/1997 Hilton
5,956,062 A 9/1999 Omata et al.
6,139,136 A 10/2000 Mackay et al.
6,145,954 A 11/2000 Moore
6,193,363 B1 2/2001 Kelly
6,196,668 B1 3/2001 Bode
6,203,136 B1 * 3/2001 Takahashi et al. ..... 347/29
6,296,353 B1 10/2001 Thielman et al.
6,302,516 B1 10/2001 Brooks et al.
6,324,898 B1 12/2001 Cote et al.
6,454,835 B1 9/2002 Baumer
6,513,918 B1 2/2003 Faisst et al.
6,517,189 B2 2/2003 Ogawa et al.

(Continued)

FOREIGN PATENT DOCUMENTS

JP 2009083374 A * 4/2009

OTHER PUBLICATIONS

Machine generated English translation of specification in JP2009-083374 to Nakano et al., "Liquid Storage Tank for Ink Jet Printer," generated via http://www.ipdl.inpit.go.jp/homepg_e.ipdl on Dec. 19, 2012; 8 pp.*

(Continued)

*Primary Examiner* — Shelby Fidler
(74) *Attorney, Agent, or Firm* — Maginot, Moore & Beck, LLP

(57) ABSTRACT

An ink delivery system is configured to supply ink to an ink reservoir fluidly coupled to inkjet ejectors and remove ink from a receptacle mounted proximate to the ink reservoir using a single conduit. The ink reservoir is configured to prevent air from being pulled through a reservoir membrane, and a reversible pump is configured to produce positive and negative pressure in the conduit to supply ink to the ink reservoir and remove ink from the receptacle, respectively.

12 Claims, 7 Drawing Sheets

(56) References Cited

U.S. PATENT DOCUMENTS

| | | | | |
|---|---|---|---|---|
| 6,578,948 | B2 | 6/2003 | Shima | |
| 6,685,310 | B2 * | 2/2004 | Kaga et al. | 347/87 |
| 6,698,870 | B2 | 3/2004 | Gunther | |
| 6,799,842 | B2 | 10/2004 | Barinaga et al. | |
| 6,955,423 | B2 | 10/2005 | Rodriquez Mojica et al. | |
| 6,997,972 | B2 | 2/2006 | Tseng | |
| 7,104,637 | B1 | 9/2006 | Van Steenkiste | |
| 7,150,519 | B2 | 12/2006 | Kono et al. | |
| 7,316,467 | B2 | 1/2008 | Toki | |
| 7,449,051 | B2 | 11/2008 | Olsen | |
| 7,455,387 | B2 | 11/2008 | Cunnington et al. | |
| 7,597,430 | B2 | 10/2009 | Umeda | |
| 7,611,568 | B2 | 11/2009 | Kang et al. | |
| 7,621,982 | B2 | 11/2009 | Kang et al. | |
| 7,625,080 | B2 | 12/2009 | Hess et al. | |
| 2003/0067518 | A1 | 4/2003 | Ishinaga et al. | |
| 2005/0146582 | A1 | 7/2005 | Platt et al. | |
| 2005/0151798 | A1 | 7/2005 | Merz et al. | |
| 2006/0152558 | A1 | 7/2006 | Hoisington | |
| 2006/0244799 | A1 * | 11/2006 | Sasa et al. | 347/89 |
| 2007/0024681 | A1 | 2/2007 | Umeda | |
| 2007/0081043 | A1 | 4/2007 | Silverbrook | |
| 2008/0007601 | A1 | 1/2008 | Tsai et al. | |
| 2008/0122901 | A1 * | 5/2008 | Platt et al. | 347/85 |
| 2008/0273071 | A1 | 11/2008 | Brown et al. | |
| 2008/0297577 | A1 | 12/2008 | Wouters et al. | |
| 2009/0322831 | A1 | 12/2009 | Emerton et al. | |
| 2010/0026739 | A1 * | 2/2010 | Hirashima | 347/85 |
| 2010/0097417 | A1 | 4/2010 | Hill | |

OTHER PUBLICATIONS

Office Action for U.S. Appl. No. 12/890,998, mailed Nov. 14, 2012, United States Patent and Trademark Office (26 pages).

Amendment in Response to Office Action for U.S. Appl. No. 12/890,998, submitted Jan. 14, 2013 (12 pages).

* cited by examiner

METHOD AND APPARATUS FOR PURGING AND SUPPLYING INK TO AN INKJET PRINTING APPARATUS

TECHNICAL FIELD

This disclosure relates generally to machines that pump fluid to and from a reservoir via a single conduit, and more particularly, to a printer configured to pump liquid ink between a reservoir and an inkjet printing apparatus through a conduit.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form, either as pellets or as ink sticks of colored cyan, yellow, magenta and black ink, that are inserted into feed channels in a printer through openings to the channels. After the ink sticks are fed into the printer, they are urged by gravity or a mechanical actuator to a heater assembly of the printer. The heater assembly includes a heater and a melt plate. The heater, which converts electrical energy into heat, is positioned proximate the melt plate to heat the melt plate to a temperature that melts an ink stick coming into contact with the melt plate. The melt plate may be oriented to drip melted ink into a reservoir and the ink stored in the reservoir continues to be heated while awaiting subsequent use.

Each reservoir of colored, liquid ink may be fluidly coupled to one or more inkjet ejectors through at least one manifold pathway. The liquid ink is pulled from the reservoir as the ejectors emit ink drops onto a receiving medium or imaging member. The inkjet ejectors may be piezoelectric devices that receive the liquid ink and eject the ink onto an imaging surface. The inkjet ejectors are selectively activated by a controller with a driving signal.

Conduits typically employed in some implementations for transporting ink between a reservoir and one or more inkjet ejectors may be referred to as "umbilicals". An umbilical is a flexible conduit fluidly coupled to an inkjet printing apparatus at one end and one or more ink supplies at another end. An umbilical may contain one or many separate channels for transporting fluids such as ink. Typical prior art umbilical assemblies include one or more conduits formed from a flexible material, such as extruded silicone, for example. During operation, the delivery conduits are filled with ink so as to avoid inserting air bubbles into the inkjet printing apparatus. Air bubbles suspended in ink supplying the jet stack may cause ejector misfires during imaging operations.

During maintenance and cleaning operations, ink within a reservoir coupled to the inkjet ejectors may be purged through the inkjet ejectors. A receptacle or catch may be used to capture and hold the purged ink. The receptacle is emptied after a purge operation, typically by pulling the ink out of the receptacle through a conduit to which a negative pressure source has been applied. This conduit that removes purged ink is different than the conduit that supplies ink to the reservoir. Thus, supplying ink to known inkjet printing apparatuses and removing purged ink from these apparatuses requires multiple conduits. Improvements in ink transport to and from inkjet printing apparatuses are desirable.

SUMMARY

An inkjet printing apparatus configured to receive ink and remove ink from a receptacle using a single conduit has been developed. The inkjet printing apparatus includes an ink reservoir configured to store ink, a port extending into the ink reservoir that fluidly communicates with the ink reservoir, a weir extending from a floor of the ink reservoir to a position within the ink reservoir that divides the ink reservoir into a first chamber and a second chamber, a wall extending from a ceiling of the ink reservoir to a position within the first chamber that is below the position to which the weir extends, a portion of a volume between the wall, the ceiling of the ink reservoir, and a side of the first chamber being configured to hold a predetermined volume of air, a membrane having pores that is positioned in the first chamber of the ink reservoir below the wall and between the weir and the port in the ink reservoir to enable all ink passing from the port to the second chamber to flow through pores in the membrane, a plurality of inkjet ejectors in fluid communication with the second chamber, each inkjet ejector configured to receive ink from the second chamber and eject ink from an aperture formed in each inkjet ejector, and a receptacle mounted proximate to the plurality of inkjet ejectors, the receptacle having a first opening that is configured to receive ink purged from the ink reservoir and a second opening that fluidly communicates with the port in the ink reservoir.

A method of transferring ink into and out of an inkjet printing apparatus has been developed. The method includes operating a pump in a first direction to move ink through a conduit and into an ink reservoir, and operating the pump in a second direction to remove ink from a receptacle mounted to the ink reservoir through the conduit.

A system for moving ink into and out of an inkjet printing apparatus has been developed. The system includes an inkjet printing apparatus having an ink reservoir, a receptacle, a container of liquid, a conduit, a check valve, and a pump. The inkjet printing apparatus includes a port extending into the ink reservoir that fluidly communicates with the ink reservoir, a weir extending from a floor of the ink reservoir to a position within the ink reservoir that divides the ink reservoir into a first chamber and a second chamber, a wall extending from a ceiling of the ink reservoir to a position within the first chamber that is below the position to which the weir extends, a portion of a volume between the wall, the ceiling of the ink reservoir and a side of the first chamber being configured to hold a predetermined volume of air, a membrane having pores positioned in the first chamber of the ink reservoir below the wall and between the weir and the port in the ink reservoir to enable all ink passing from the port to the second chamber to flow through pores in the membrane, and a plurality of inkjet ejectors in fluid communication with the second chamber, each inkjet ejector configured to receive ink from the second chamber and eject ink from an aperture formed in each inkjet ejector. The receptacle is mounted proximate the plurality of inkjet ejectors, the receptacle having a first opening that is configured to receive ink purged from the plurality of inkjet ejectors and a second opening that fluidly communicates with the port in the ink reservoir. The container of liquid ink has at least an outlet. The conduit is configured to connect fluidly the outlet of the liquid ink container to the port of the ink reservoir and to the second opening of the receptacle. The check valve is positioned at the second opening in the receptacle, the check valve being configured to enable ink and air to flow from the receptacle through the second into the conduit and to block ink and air flow from the conduit into the receptacle through the second opening. The pump is configured to operate in a first direction and a second direction. Operation of the pump in the first direction moves ink from the container of liquid ink through the conduit to the ink reservoir through the port, and operation of the pump in the second direction pulls ink from the receptacle through the second opening into the conduit.

DETAILED DESCRIPTION OF THE DRAWINGS

Figure 1:
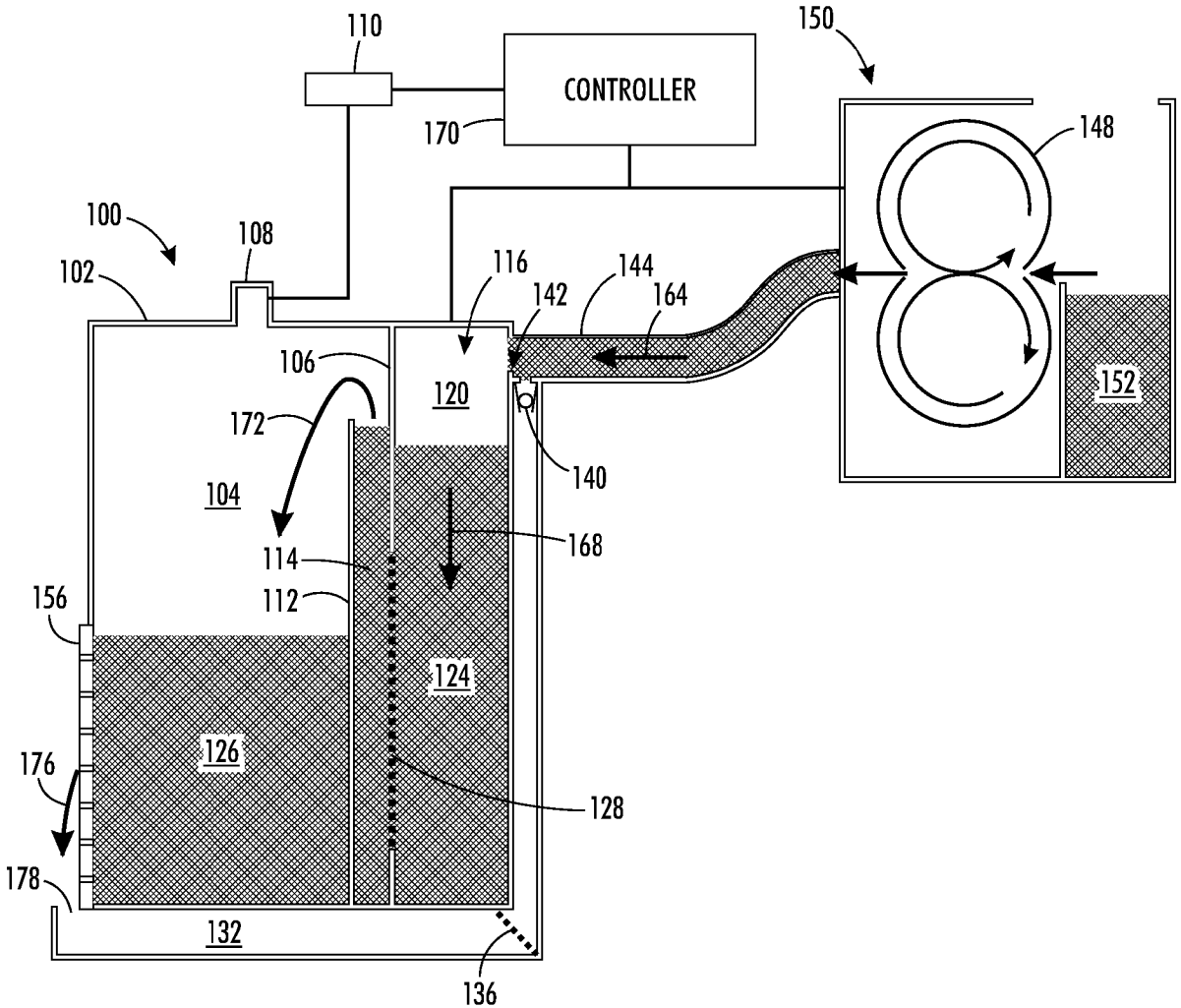
FIG. 1 is a schematic diagram of an inkjet printing apparatus and reservoir operatively connected by a single fluid conduit at the start of a purge operation.

For a general understanding of the environment for the system and method disclosed herein as well as the details for the system and method, reference is made to the drawings. In the drawings, like reference numerals have been used throughout to designate like elements. The term "meniscus" refers to an attraction of a liquid, such as ink, to a material surrounding an opening in a material, such as a pore in a membrane positioned across a path for the liquid. The meniscus holds the liquid in the pore until a higher pressure is reached that breaks the liquid attraction to itself and/or the membrane material and pulls gas through the pore. Consequently, a membrane having wetted pores enables liquids to be pulled through the pores of the membrane while preventing a gas from passing through the membrane as long as the pressure across the wetted pores remains below the pressure that breaks the meniscus. The term "weir" refers to a wall positioned within a chamber that is as wide as the chamber, but not as tall as the chamber. Thus, liquid builds behind the weir until it reaches the top of the weir and then overflows into the chamber. In this manner, the liquid level on the two sides of the weir may be maintained at different heights. The term "conduit" refers to a body having a passageway or lumen through it for the transport of a liquid or a gas. As used herein, "purging ink" refers to any emission of ink from an inkjet ejector that does not land on an image receiving member whether deliberate or accidental. Purged ink refers to ink emitted from the ejector during purging.

Referring to FIG. 1, a liquid ink delivery system is shown. The system includes an inkjet printing apparatus 100 that is operatively coupled to an external ink supply 150 via a conduit 144. External ink supply 150 is configured to pump ink and gas through conduit 144 into inkjet printing apparatus 100 in a forward direction, and to withdraw ink and gas through conduit 144 from inkjet printing apparatus 100 in a reverse direction.

Inkjet printing apparatus 100 includes a manifold chamber 104, ink inlet chamber 116, a plurality of inkjet ejectors 156, a vent 108, a receptacle 132 mounted to a reservoir, seen here as manifold 104, and ink inlet chamber 116. A weir 112 extends upwards between ink inlet chamber 116 and manifold 104. Ink inlet chamber 116 also contains a reservoir filter 128, and a head space 120. Ink exits the conduit 144 to enter the ink inlet chamber 116 through a port 142 extending through a side of ink inlet chamber 116. The ink passes through the pores of the reservoir filter 128, overflows weir 112, and enters manifold 104. Manifold 104 holds ink 126 until the action of the diaphragms in the inkjet ejectors 156 produce negative pressure that pulls ink 126 from the manifold 104 into the inkjet ejectors 156 and then ejects the ink through a plurality of apertures. The ejectors 156 are formed with an inkjet ejector stack as is well known in the art. The inkjet ejectors 156 are shown in direct fluid communication with manifold 104 in FIG. 1, but in various alternative embodiments the ejectors can be somewhat distant from the manifold 104 and may be coupled to an ink supply through various conduits and intermediate chambers. Ink purged through the inkjet ejectors in a manner described more fully below, drips down from the apertures and is collected in the ink receptacle 132.

In the embodiment of FIG. 1, reservoir filter 128 may be a membrane that includes a plurality of pores with each pore being approximately 10 μm in size, although other pore sizes may be used depending upon the pressures produced within the inkjet printing apparatus and the properties of the ink. A suitable material for reservoir filter 128 is a porous polymer film. While the reservoir filter 128 extends across the entire width of the ink inlet chamber 116, the height of the filter 128 does not reach the ceiling of the ink inlet chamber 116. Instead, a head space wall 106 extends from the ceiling of the ink inlet chamber to a position within the space between the weir 112 and the port 142 that is lower than the top of the weir 112. The head space 120 formed between the head space wall 106 and a wall of the ink inlet chamber 116 is configured with a volume that accommodates at least a volume of air equal to the volume of the conduit 144 filled with air. Configuring the head space 120 with a slightly larger volume provides a margin that helps ensure the air within the head space 120 does not contact reservoir filter 128. The head space wall 106 may be a stub wall that extends across the ink reservoir of the inkjet printing apparatus or it may be a wall extending from the ceiling to the floor of the ink reservoir. In the former configuration, the filter 128 may extend from the lower end of the head space wall 106 to the floor of the ink reservoir or to a stub wall extending from the floor of the ink reservoir. In the latter configuration, the filter 128 is mounted within an opening in the head space wall 106. Either configuration enables ink inlet chamber 116 to hold a volume of ink 124 against the filter 128 with a volume of air maintained in the head space 120 above the ink 124 at the port 142. Weir 112 extends upwardly between ink inlet chamber 116 and manifold 104. Weir 112 maintains ink 124 held in ink inlet chamber 116 at a higher level than the ink 126 held in manifold 104.

Vent 108 is opened to connect the internal space of the inkjet printing apparatus to atmospheric pressure during imaging operations. This operation enables an outside gas, such as air, to enter the manifold 104 while ink drops are ejected from inkjet ejectors 156. To connect the internal space of the inkjet printing apparatus 100 to the atmosphere selectively, an actuator 110, such as a solenoid, is positioned at an opening of vent 108. The actuator 110 may be operatively connected to a controller, discussed below, to operate actuator 110 and selectively open and close vent 108. In FIG. 1, vent 108 is closed to allow ink 126 held in manifold 104 to be purged through the apertures.

As noted above, receptacle 132 is positioned to collect ink purged through inkjet ejectors 156. The receptacle 132 extends from external opening 178 to an opening in direct fluid communication with conduit 144. A check valve 140 is placed between the opening of receptacle 132 and the position at which it fluidly communicates with conduit 144. Check valve 140 remains closed whenever gas or liquid is pumped in a forward direction through conduit 144 into ink inlet chamber 116 to prevent ink from entering receptacle 132. In one embodiment, check valve 140 includes a ball that is gravity biased into a seat to block an opening in check valve 140, although any suitable check valve, including spring-loaded check valves, may be used. Receptacle 132 includes a receptacle ink filter 136, which may be a membrane placed between external opening 178 and check valve 140. In one embodiment, the pores of receptacle ink filter 136 are larger in diameter than the pores in reservoir filter 128, and in one particular embodiment, the pores of the receptacle ink filter 136 are approximately 60 μm in diameter.

External ink supply 150 includes an ink reservoir 152 and a pump 148. The ink reservoir 152 is in fluid communication with conduit 144 and the pump 148 is configured to operate in a forward direction and a reverse direction. That is, pump 148 may be operated in one direction to produce positive pressure to expel ink from the supply 150 through the conduit 144 into the inlet chamber 116 and in the opposite direction to produce negative pressure to pull ink or gas from either inlet chamber 116 and/or receptacle 132. In aqueous ink printers, the liquid ink may be held in an ink cartridge, while in phase change ink printers, solid ink may be liquefied using a heated melt plate and fed by gravity to reservoir 152. Pump 148 is shown operating in the forward direction in FIG. 1, where the forward direction supplies ink from external ink supply 150 to inkjet printing apparatus 100 via conduit 144. In the embodiment of FIG. 1, pump 148 is a gear pump, although alternative pumps configured to pump in the forward and reverse directions may be used.

In the embodiment of FIG. 1, conduit 144 may be an umbilical formed with a flexible hose having a single passageway that is configured to enable ink and gas to be pumped to and from the inkjet printing apparatus 100. In a typical embodiment, gas in the inkjet printing apparatus 100 and conduit 144 is air that is drawn from an atmosphere surrounding the inkjet printing apparatus 100 and the conduit 144. At one end, conduit 144 is in fluid communication with external ink supply 150 and pump 148. At another end, conduit 144 is in fluid communication with a junction of ink inlet chamber 116 and receptacle 132 via check valve 140. As noted above, conduit 144 has an internal volume that is accommodated in the head space 120 without exposing the reservoir filter 128 to air from the conduit.

The operations of components in inkjet printing apparatus 100 and external ink supply 150 including, but not limited to, opening and closing the actuator 110 of vent 108, operating pump 148, and operating inkjet ejectors 156 are governed by a controller 170. Typical embodiments of the controller 170 include a microprocessor device such as a central processing unit (CPU), an application specific integrated circuit (ASIC), a field programmable device, or a microcontroller. Controller 170 may operate the inkjet printing apparatus 100 and external ink supply 150 in accordance with software or firmware commands. Various printing devices may employ one or multiple electronic devices providing the functionality of controller 170. The controller is configured with electrical components and programmed instructions stored in memory operatively connected to the controller to perform the functions described in this document along with other known functions for operating an inkjet printer.

In FIG. 1, inkjet printing apparatus 100 is configured to begin purging manifold ink supply 126 from manifold 104. Vent 108 is closed by actuator 110, and a predetermined amount of ink from ink reservoir 152 is pumped towards the inkjet printing apparatus 100 via conduit 144 as shown by arrow 164. The ink exits the conduit 144, enters the ink inlet chamber 116 shown by arrow 168, and goes over the weir 112 as shown by arrow 172. This movement of ink also urges ink from the manifold into the inkjet ejectors and out through the apertures of the inkjet ejectors 156. While ink is pumped into the ink inlet chamber 116, check valve 140 remains closed, preventing ink from passing from conduit 144 into receptacle 132. During a purge operation, ink flows continuously from the inkjet ejectors 156 instead of being ejected as individual drops as is typical during imaging operations. The purged ink flows down the printing apparatus 100 as shown by arrow 176 into opening 178 of receptacle 132. An alternative inkjet printing apparatus configuration may purge ink in manifold 104 by supplying pressurized gas to the manifold 104 to urge manifold ink 126 through the inkjet ejectors 156.

Figure 2:
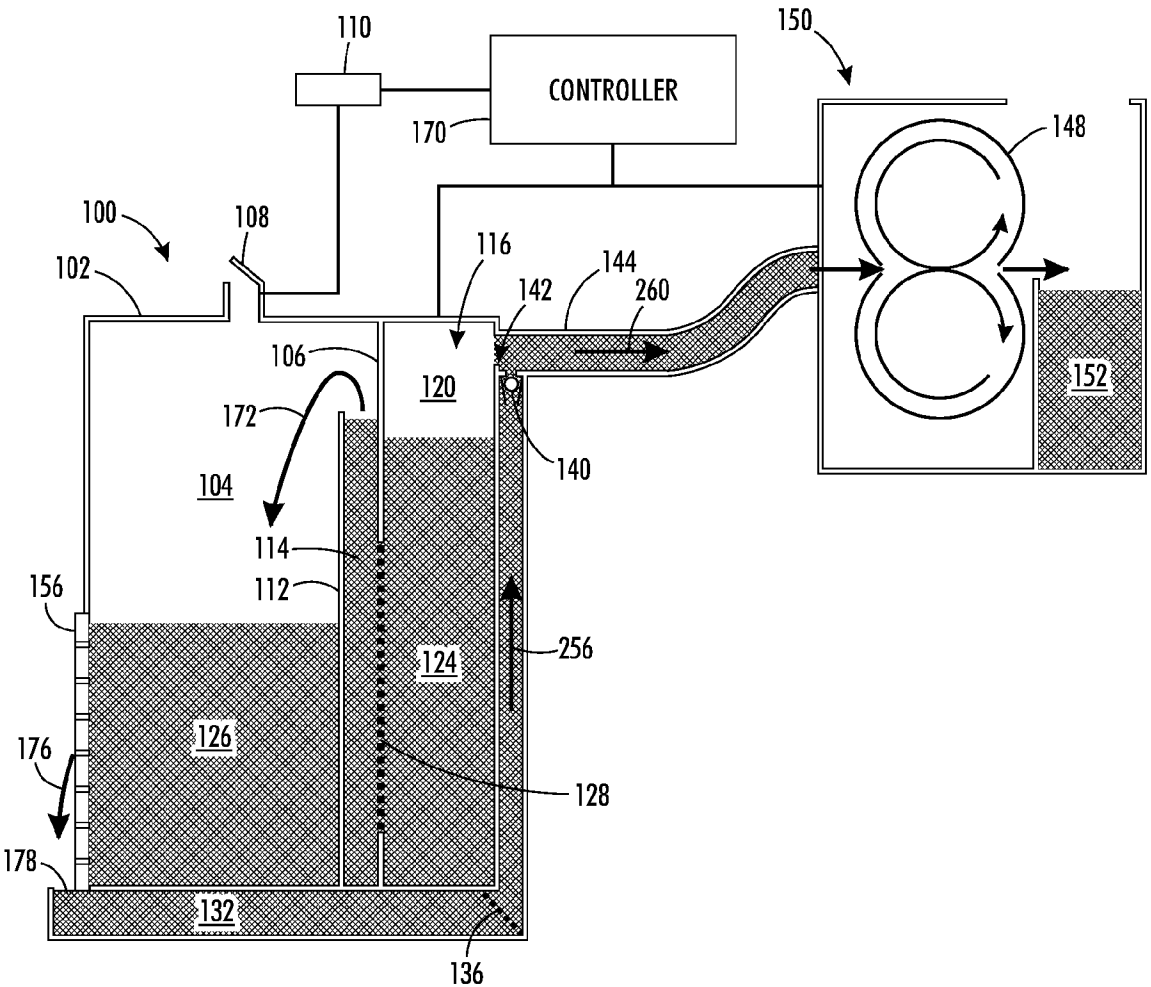
FIG. 2 is a schematic diagram of an inkjet printing apparatus and reservoir operatively connected by a single fluid conduit with purged ink in a receptacle as ink is removed from the receptacle.

FIG. 2 depicts inkjet printing apparatus 100 after the purging operation is complete. In FIG. 2 the purged ink 238 is held in receptacle 132. Actuator 110 opens vent 108 to allow gas to vent into manifold 104. Pump 148 is operated in the reverse direction, allowing check valve 140 to open and purged ink 238 to withdraw from receptacle 132 shown by arrow 256 through conduit 144 shown by arrow 260 and into the external ink supply 150. Purged ink 238 withdrawn from receptacle 132 may be directed to ink reservoir 152, or may be diverted to a waste ink receptacle (not shown).

In FIG. 2, the action of pump 148 withdraws purged ink 238 directly from receptacle 132 instead of from ink inlet chamber 116. The larger pores in the receptacle ink filter 136 allow purged ink 238 to flow directly into conduit 144 more easily than from head space 120 or ink volume 124, which are in fluid communication with the reservoir filter 128. Thus, ink held in receptacle 132 is withdrawn first in response to the reverse pumping action of pump 148. A small amount of air in head space 120 may be pulled into the ink flow until sufficient negative pressure discourages further air from being withdrawn.

Figure 3:
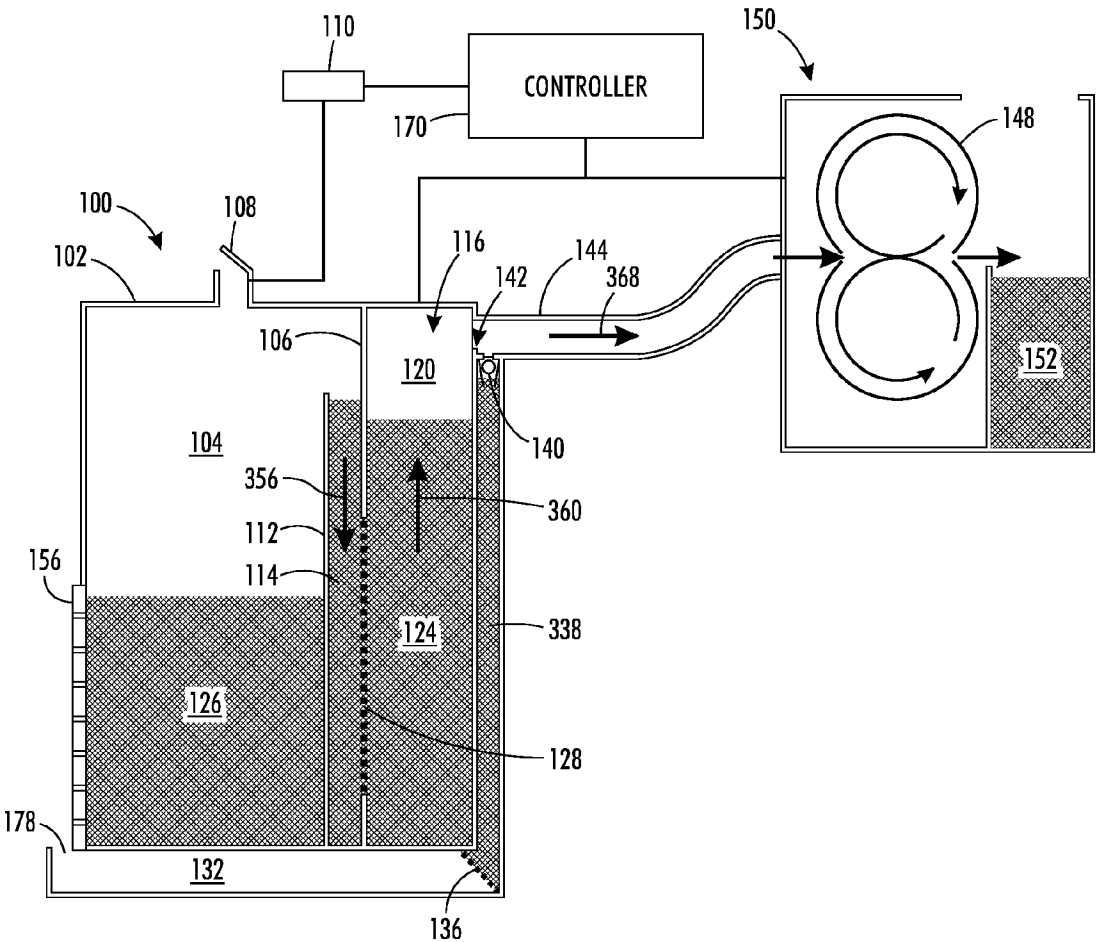
FIG. 3 is a schematic diagram of an inkjet printing apparatus and reservoir operatively connected by a single fluid conduit as an air pocket is removed from an ink inlet chamber via the single fluid conduit.

FIG. 3 depicts inkjet printing apparatus 100 and external ink supply 150 after ink has been withdrawn from receptacle 132. In FIG. 3, the portion of ink in ink receptacle 132 on the distal side of receptacle ink filter 136 from conduit 144 has been withdrawn from receptacle 132. At this point, the distal side of receptacle ink filter 136 is exposed to gas, while the proximal side of receptacle ink filter 136 has residual ink 338 between receptacle ink filter 136 and conduit 144. A fluid meniscus forms across wetted receptacle ink filter 136, and the strength of the attraction between residual ink 338 and the filter material surrounding the pores in the filter 136 resists the flow of gas through receptacle 132. The strength of the fluid meniscus across receptacle filter 136 provides a resistance to gas flowing across the filter that is greater than resistance to fluid flow through ink inlet chamber 116. In response, gas held in head space 120 of ink inlet chamber 116 is withdrawn through ink conduit 144, as shown by arrow 368, to external ink supply 150.

As gas in head space 120 is withdrawn, ink volume 114 between weir 112 and reservoir filter 128 passes through the filter 128 and moves back into the ink inlet chamber 116 as shown by arrow 356. This ink raises the level of ink in the ink inlet chamber 116 as shown by arrow 360. The volume of ink 114 is sufficient to offset the volume of gas withdrawn from head space 120. In the example embodiment of FIG. 3, head space 120 has a volume of approximately three milliliters, corresponding substantially to the size of ink volume 114 or less. Gas from head space 120 is withdrawn through conduit 144.

Figure 4:
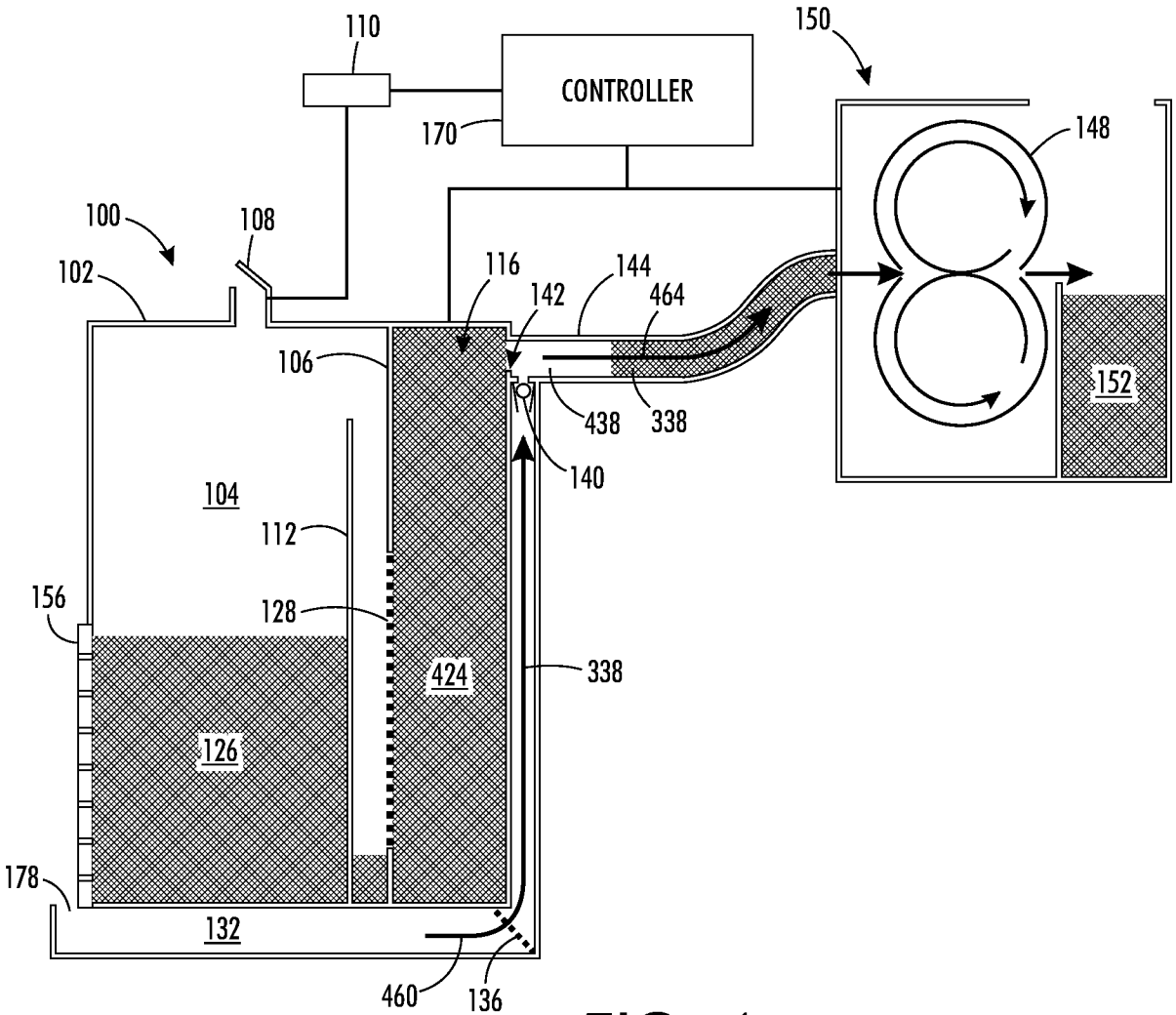
FIG. 4 is a schematic diagram of an inkjet printing apparatus and reservoir operatively connected by a single fluid conduit as ink and air are pumped from a receptacle via the single fluid conduit.

As shown in FIG. 4, once a substantial portion of the gas in head space 120 is withdrawn, the level of ink between the weir 112 and the reservoir filter 128 drops and the reservoir filter 128 is exposed to gas, which is typically air vented through vent 108. In FIG. 4, ink inlet chamber 116 is substantially filled with ink volume 424. Ink volume 424 keeps the reservoir filter 128 wet to maintain a meniscus across the pores of the filter 128. The attraction between the ink and the filter material resists the flow of gas into the inlet chamber 116. The relative strength of the meniscus at the reservoir filter 128 is higher than the strength of the meniscus at the receptacle ink filter 136 due to the smaller size of pores present in the reservoir filter 128. The relatively lower meniscus strength of receptacle ink filter 136 compared to reservoir filter 128 enables gas to be pulled through the pores of the filter 136 to enable residual ink 338 and gas 438 in the receptacle 132 to be withdrawn through opened check valve 140, as shown by arrow 460. In one embodiment, pump 148 is operated in the reverse direction for a predetermined time period to withdraw purged ink from the receptacle 132, then draw down the gas in the head space, and then finish evacuation of the residual ink 338 and gas 438 from receptacle 132 through conduit 144 as shown by arrow 464. Ink in conduit 144 is replaced by gas 438 withdrawn from receptacle 132.

Figure 5:
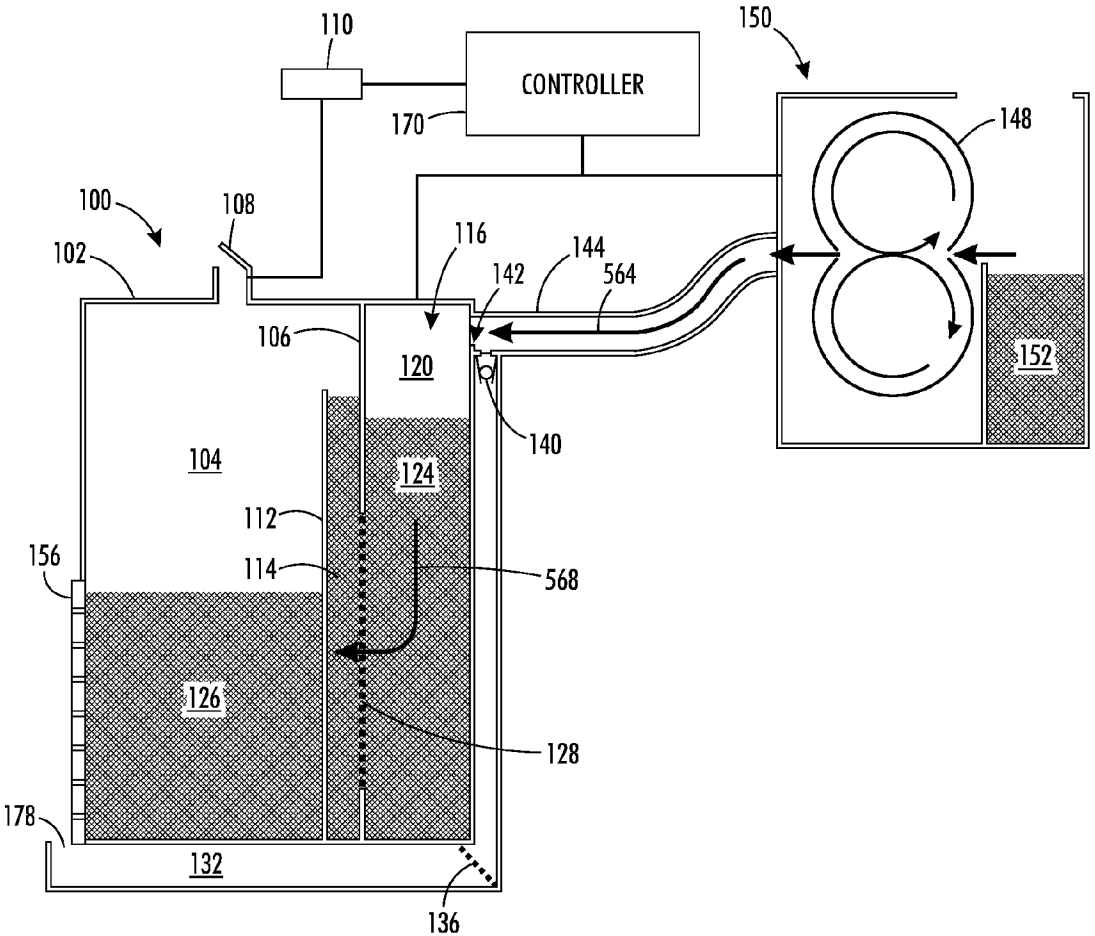
FIG. 5 is a schematic diagram of an inkjet printing apparatus and reservoir operatively connected by a single fluid conduit with air being pumped into an ink inlet chamber via the single fluid conduit.

FIG. 5 depicts inkjet printing apparatus 100 and external ink supply 150 with pump 148 operating in a forward direction to pump gas held in conduit 144 into ink inlet chamber 116 along arrow 564. Check valve 140 remains closed during forward operation of pump 148. As gas enters head space 120, ink is displaced through reservoir filter 128 and ink volume 114 forms between weir 112 and reservoir filter 128 as shown by arrow 568. A volume of gas held in conduit 144 fills the volume of head space 120, with head space 120 having a volume of one to two milliliters in the example embodiment of FIG. 5. The ink inlet chamber 116 of FIG. 5 is configured to operate with a head space 120 of up to approximately three milliliters in volume to allow for excess gas which may enter the inkjet printing apparatus 100 during operation. The withdrawal of gas from head space 120 seen in FIG. 3 and the resupply of gas seen in FIG. 5 regulate the size of the head space 120, which helps ensure gas bubbles the size of the pores in filter 128 are not formed in the inkjet printing apparatus 100. Additionally, the dimensions of the ink inlet chamber 116 are selected to prevent viscous forces present in the ink from pushing air through the reservoir filter 128 and forming bubbles of gas in the ink within the inkjet printing apparatus 100.

Figure 6:
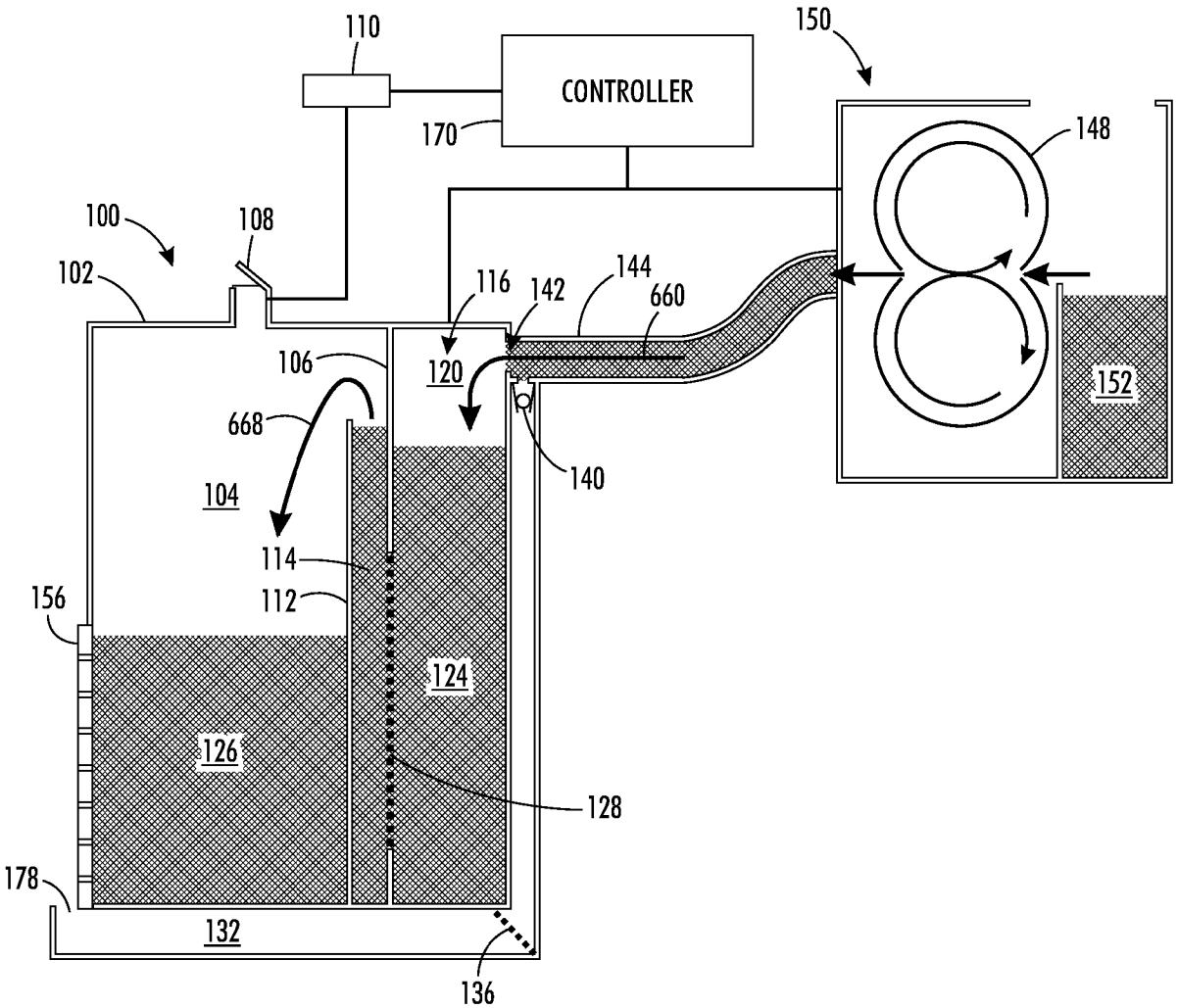
FIG. 6 is a schematic diagram of an inkjet printing apparatus and reservoir operatively connected by a single fluid conduit with ink being pumped into a manifold in the inkjet printing apparatus via the single fluid conduit.

Referring to FIG. 6, pump 148 operates in a forward direction, supplying ink to inkjet printing apparatus 100. Ink from reservoir 152 is pumped from external ink supply 150 through conduit 144 as shown by arrow 660. Ink from conduit 144 supplies ink volume 124 in ink inlet chamber 116. Weir 112 maintains the level of ink volume 124, and additional ink added to the ink inlet chamber 116 overflows the weir 112 as shown by arrow 668. Ink overflowing the weir 112 enters ink manifold 104 forming manifold ink supply 126. Ink in manifold ink supply 126 is available for drop generation during imaging operations by inkjet ejectors 156.

Figure 7:
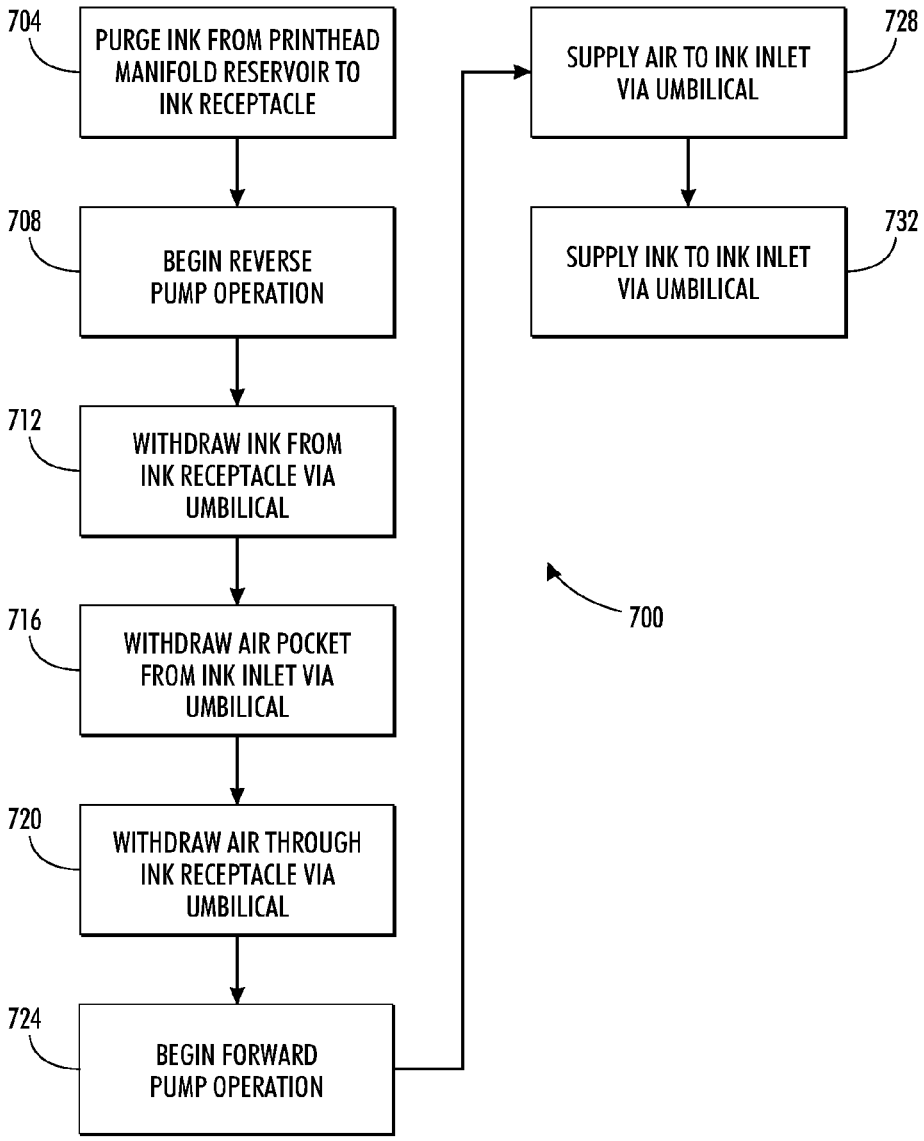
FIG. 7 is a block diagram of a process for purging ink from an inkjet printing apparatus using a single umbilical conduit that is also used for supplying ink to the inkjet printing apparatus.

A process 700 for purging and supplying ink to a an inkjet printing apparatus using a single conduit, or umbilical, which may be employed with the foregoing inkjet printing apparatus is depicted in FIG. 7. Process 700 begins by purging ink from the manifold reservoir in the inkjet printing apparatus (block 704). As shown in FIG. 1, ink in the manifold reservoir may be purged by passing more ink through the manifold reservoir and allowing the ink to flow through inkjet ejectors. Alternatively, residual ink may be forced out by air pressure applied to the manifold chamber. Purged ink flows outside of apertures in each ejector and is captured in a receptacle.

Process 700 continues by operating a pump fluidly connected to an umbilical with a single conduit in a reverse direction (block 708). The reverse direction applies suction to the umbilical, which is in fluid communication with an ink inlet chamber in the inkjet printing apparatus and an opening of the ink receptacle covered by a check valve. As suction is applied, ink is withdrawn directly from the receptacle (block 712). The check valve at the opening of the receptacle opens and ink flows from the receptacle into the umbilical. The resistance to fluid flow of the ink receptacle is lower than a resistance to fluid flow of the ink inlet chamber. Thus, gas and liquid ink remain in the ink inlet chamber, even though the ink inlet chamber remains in fluid communication with the umbilical.

Process 700 continues by withdrawing air held in a head space within the ink inlet chamber (block 716). When sufficient ink is withdrawn from the ink receptacle that one side of the ink receptacle filter is exposed to air, the relative resistance to flow of the ink receptacle increases above the resistance to flow of the ink inlet chamber. Air in the head space is withdrawn through the umbilical. As air is withdrawn from the ink inlet chamber, the volume of the head space is replaced by ink displaced from a volume of ink held between a weir and a reservoir filter arranged across the ink inlet chamber. The volume of ink between the weir and the reservoir filter corresponds to at least the volume of air in the head space, and the reservoir filter is exposed to air once the ink between the weir and the reservoir filter is withdrawn. An ink meniscus forms between ink the in the inlet chamber and the material in the reservoir filter surrounding the pores that prevents air on the surface of the reservoir filter from forming bubbles in ink held in the ink inlet chamber.

In response to the reservoir filter being exposed to air, residual ink and air are withdrawn through the receptacle via the umbilical instead (block 720). Once the reservoir filter is exposed to air, the resistance to flow of ink in the ink inlet chamber rises. The relative resistance to flow of the receptacle is lower than that of the ink inlet chamber. Residual ink held in the ink receptacle as well as air are withdrawn through the ink receptacle, passing through the opened check valve and through the umbilical. Ink in the umbilical is replaced by air withdrawn from the ink receptacle.

After a predetermined period of time, the pump switches direction and begins pumping in the forward direction (block 724). The check valve leading to the ink receptacle closes, and air held in the umbilical is supplied to the ink inlet chamber (block 728). The umbilical is configured to have an internal volume of air which is small enough to supply air to form the head space without driving gas bubbles into ink held in the ink inlet chamber and weir. Once the head space is established, liquid ink from an external ink reservoir is supplied to the ink inlet chamber via the umbilical (block 732). The excess ink in the ink inlet chamber increases the corresponding level of ink behind the weir, causing ink to overflow and fill the manifold reservoir. Ink in the manifold reservoir is available for use in inkjet imaging operations.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An inkjet printing apparatus comprising:

an ink reservoir configured to store ink, a port extending into the ink reservoir that fluidly communicates with the ink reservoir;

a weir extending from a floor of the ink reservoir to a position within the ink reservoir that divides the ink reservoir into a first chamber and a second chamber;

a wall extending from a ceiling of the ink reservoir to a position within the first chamber that is below the position to which the weir extends, a portion of a volume between the wall, the ceiling of the ink reservoir, and a side of the first chamber being configured to hold a predetermined volume of air;

a membrane having pores that is positioned in the first chamber of the ink reservoir below the wall and between the weir and the port in the ink reservoir to enable all ink passing from the port to the second chamber to flow through pores in the membrane;

a plurality of inkjet ejectors in fluid communication with the second chamber, each inkjet ejector configured to receive ink from the second chamber and eject ink from an aperture formed in each inkjet ejector; and a receptacle mounted proximate to the plurality of inkjet ejectors, the receptacle having a first opening that is configured to receive ink purged from the ink reservoir and a second opening that fluidly communicates with the port in the ink reservoir.

2. The inkjet printing apparatus of claim 1 further comprising:

a check valve positioned at the second opening in the receptacle, the check valve being configured to enable ink and air to flow from the receptacle through the second opening and to block ink and air flow into the receptacle through the second opening.

3. The inkjet printing apparatus of claim 1 further comprising:

a membrane having pores that is positioned within the receptacle between the first opening and the second opening, the pores in the membrane positioned within the receptacle having a larger diameter than the pores of the membrane in the ink reservoir.

4. The inkjet printing apparatus of claim 3 wherein the pores in the membrane positioned in the ink reservoir being approximately 10 μm in diameter and the pores in the membrane positioned in the receptacle being approximately 60 μm in diameter.

5. The inkjet printing apparatus of claim 1 further comprising:

a conduit operatively connected to the port, the conduit having an internal volume that approximately equals the predetermined volume of air in the ink reservoir.

6. A system for moving ink into and out of an inkjet printing apparatus comprising:

an inkjet printing apparatus having an ink reservoir and a port extending into the ink reservoir that fluidly communicates with the ink reservoir, a weir extending from a floor of the ink reservoir to a position within the ink reservoir that divides the ink reservoir into a first chamber and a second chamber, a wall extending from a ceiling of the ink reservoir to a position within the first chamber that is below the position to which the weir extends, a portion of a volume between the wall, the ceiling of the ink reservoir and a side of the first chamber being configured to hold a predetermined volume of air, a membrane having pores positioned in the first chamber of the ink reservoir below the wall and between the weir and the port in the ink reservoir to enable all ink passing from the port to the second chamber to flow through pores in the membrane, and a plurality of inkjet ejectors in fluid communication with the second chamber, each inkjet ejector configured to receive ink from the second chamber and eject ink from an aperture formed in each inkjet ejector;

a receptacle mounted proximate the plurality of inkjet ejectors, the receptacle having a first opening that is configured to receive ink purged from the plurality of inkjet ejectors and a second opening that fluidly communicates with the port in the ink reservoir;

a container of liquid ink having at least an outlet;

a conduit configured to connect fluidly the outlet of the liquid ink container to the port of the ink reservoir and to the second opening of the receptacle;

a check valve positioned at the second opening in the receptacle, the check valve being configured to enable ink and air to flow from the receptacle through the second into the conduit and to block ink and air flow from the conduit into the receptacle through the second opening; and a pump configured to operate in a first direction and a second direction, operation of the pump in the first direction moves ink from the container of liquid ink through the conduit to the ink reservoir through the port, and operation of the pump in the second direction pulls ink from the receptacle through the second opening into the conduit.

7. The system of claim 6 further comprising:

a membrane having pores that is positioned within the receptacle between the first opening and the second opening, the pores in the membrane positioned within the receptacle having a larger diameter than the pores of the membrane in the ink reservoir.

8. The system of claim 7 wherein the pores in the membrane positioned in the ink reservoir are approximately 10 μm in diameter and the pores in the membrane positioned in the receptacle are approximately 60 μm in diameter.

9. The system of claim 7 wherein the pump is configured to produce a negative pressure that is greater in magnitude than a negative pressure that pulls air through the membrane positioned in the receptacle.

10. The system of claim 6 wherein the predetermined volume of air corresponds to an internal volume of the conduit.

11. The system of claim 6 further comprising:

a controller operatively connected to the pump, the controller being configured to operate the pump in the first direction and to operate the pump in the second direction selectively.

12. The system of claim 11, the controller being further configured to operate the pump in the second direction for a predetermined period of time that enables a volume of ink corresponding to a volume of the receptacle and at least the predetermined volume of air to be moved through the conduit.

* * * * *